United States Patent [19]

Rios

[11] 4,005,338

[45] Jan. 25, 1977

[54] LAMP-STARTING DEVICE

[76] Inventor: Donald J. Rios, 3923 Cranberry Lane, St. Louis, Mo. 63121

[22] Filed: Nov. 26, 1975

[21] Appl. No.: 635,649

[52] U.S. Cl. ..... 315/362; 315/71; 315/107; 338/219

[51] Int. Cl.[2] ..... H05B 39/02

[58] Field of Search ..... 315/71–73, 315/75, 94, 102, 106, 107, 119, 127, 200 R, 362; 338/200, 215, 219; 339/176 L

[56] References Cited

UNITED STATES PATENTS

| | | | |
|---|---|---|---|
| 2,110,690 | 3/1938 | Zierahn | 315/71 X |
| 2,550,169 | 4/1951 | Sokoloff | 338/219 X |
| 3,868,540 | 2/1975 | Passmore et al. | 315/73 |

*Primary Examiner*—Eugene R. LaRoche
*Attorney, Agent, or Firm*—Cohn, Powell & Hind

[57] ABSTRACT

A lamp-starting device for use in a lamp socket adapted to receive the base of a lamp, the device having a pair of electrically-conductive plates disposed in spaced relation in and electrically insulated from each other by a housing of electrically insulating material. An electrical resistor is located between and electrically connects the plates, the resistor being in the circuit when the lamp is initially energized. A temperature-responsive bimetal strip is located between the plates, the bimetal strip having a contact movable into engagement with a contact on one of the plates when the bimetal strip is heated by conductive heat from the resistor, lamp base and socket to by-pass the resistor in the circuit after initial energization, the bimetal strip being electrically connected to the other of the plates. The bimetal strip includes a loop disposed about the resistor and engaging the other plate and engaging an electrically-insulating member disposed between the plates.

7 Claims, 5 Drawing Figures

LAMP-STARTING DEVICE

BACKGROUND OF THE INVENTION

This invention relates generally to a lamp-starting device, and to improvements in a device of this type in which means located in the circuit applies less than rated voltage to the lamp when the lamp is initially energized, and means in the circuit completely electrically bypasses the first said means in the circuit and applies substantially rated voltage to the lamp after the lamp is heated. More particularly, a bimetal strip is a component part so that a resistor is either completely in or out of the lamp circuit, the bimetal strip being operated by conductive heat from the lamp socket.

The prior conventional lamp-starting devices utilized a negative temperature coefficient resistor in series with the lamp, the resistor being heated by current passing through the resistor. With this type of device, the resistance in the circuit decreases as the temperature of the negative temperature coefficient resistor increases. Accordingly, the resistor is at all times in circuit with the lamp.

SUMMARY OF THE INVENTION

The present lamp-starting device is of compact, simple construction that places a resistance of definite fixed value in the lamp circuit when the lamp circuit is initially energized, and which utilizes a bimetal strip that operates with a positive action to by-pass the resistor when the strip is heated by conductive heat from the resistor, lamp base and socket. The resistor is either completely in or out of the circuit.

For example, with this device, the lamp is turned on at about ¾ rated voltage. After about ten seconds, the conductive heat from the resistor, lamp base and socket to the lamp starter will cause the bimetal strip to close switch contacts and bypass the resistor so that full rated voltage is applied to the lamp to operate a full rated capacity. Because the lamp is turned at a relatively low voltage, and full rated voltage is applied only after the lamp filament is relatively warm, the lamp life is increased significantly.

The lamp-starting device includes an electrical resistor located between and electrically connecting a pair of electrically-conductive plates disposed in a housing of electrically-insulating material, the plates being in spaced relation and electrically insulated from each other by the housing. A temperature-responsive bimetal strip is located between the plates. One of the plates has a first contact, while a second contact is on the bimetal strip, the contacts engaging when the bimetal strip is heated by conductive heat from the resistor, lamp base and socket to by-pass the resistor in the lamp circuit after initial energization.

An electrically-insulating member is disposed between the plates, and the bimetal strip is located between the electrically-insulating member and the other of the plates. The bimetal strip has a loop portion embracing the resistor and engaging the said other plate and engaging the electrically-insulating member. The bimetal strip is positioned by the loop portion and by spaced holders on the electrically-insulating member between which the strip is received and retained.

The resistor includes a relatively enlarged portion and a relatively reduced portion, the enlarged portion being located between and engaging the said other plate and engaging the electrically-insulating member, and the reduced portion being located in an aperture provided in the electrically-insulating member and engaging the said one plate.

More particularly, the loop portion of the bimetal strip is disposed about the enlarged resistor portion; the bimetal strip has a movable end portion of slightly reduced height that carries the second contact, and the spaced holders of the electrically-insulating member retain a bimetal strip portion located between the loop portion and the movable end portion.

DESCRIPTION OF THE PREFERRED EMBODIMENT

Figure 1:
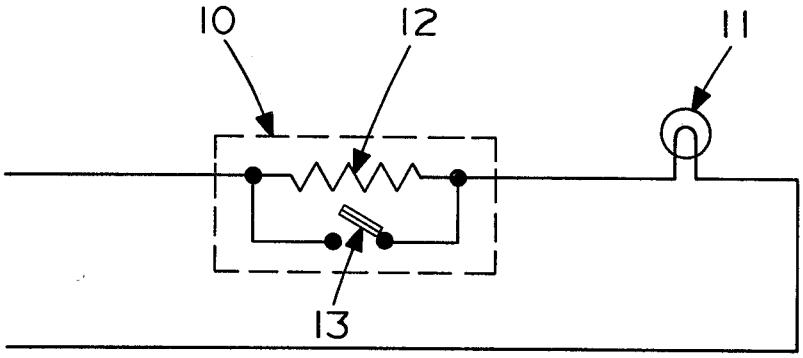
FIG. 1 is a circuit diagram of the lamp and lamp-starting device.

Referring now by characters of reference to the drawings and first to FIG. 1, a circuit diagram is illustrated in which the lamp-starting device generally indicated by 10 is connected in the circuit with the lamp 11. In this circuit diagram, the lamp-starting device 10 includes a resistor indicated by 12 connected in series with the lamp 11, and a bimetal strip referred to generally by 13 connected in parallel with the resistor 12.

Figure 2:
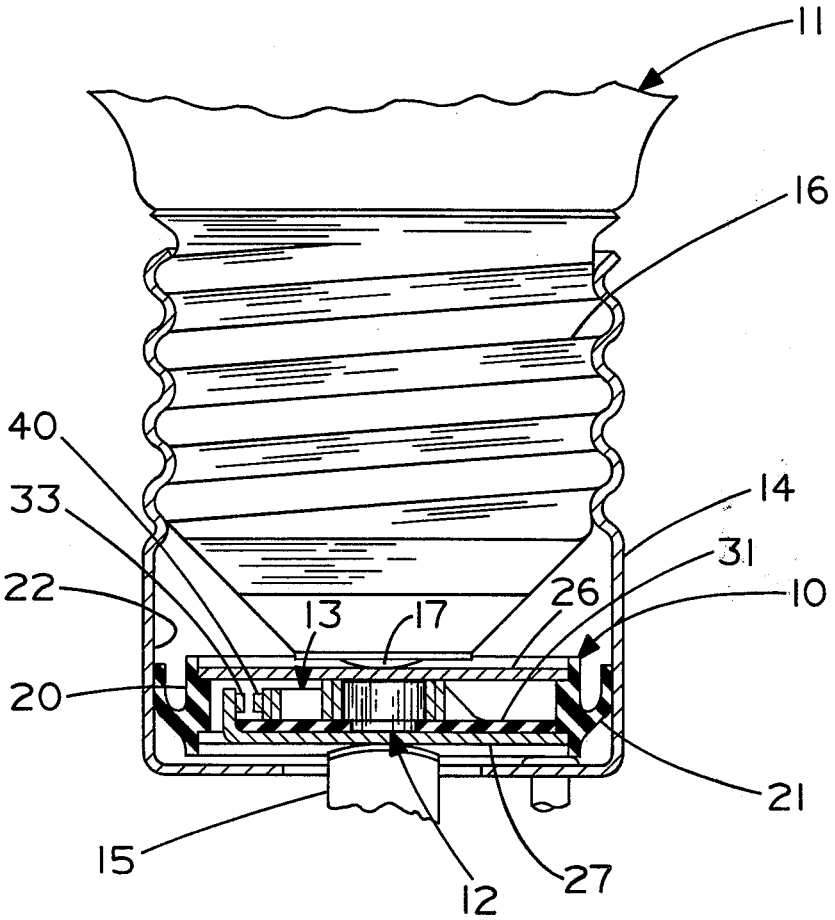
FIG. 2 is a fragmentary, enlarged cros-sectional view of the lamp-starting device in a lamp socket.
Figure 3:
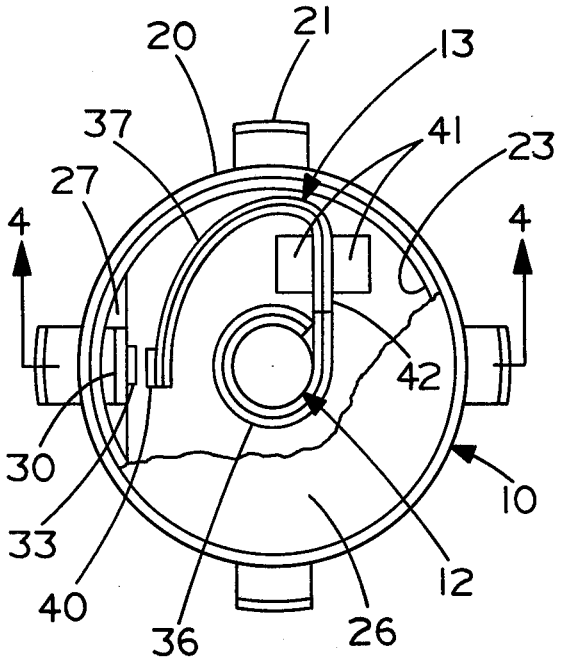
FIG. 3 is a top plan view of the lamp-starting device with its top plate partially cut-away to show the interior assembly.
Figure 4:
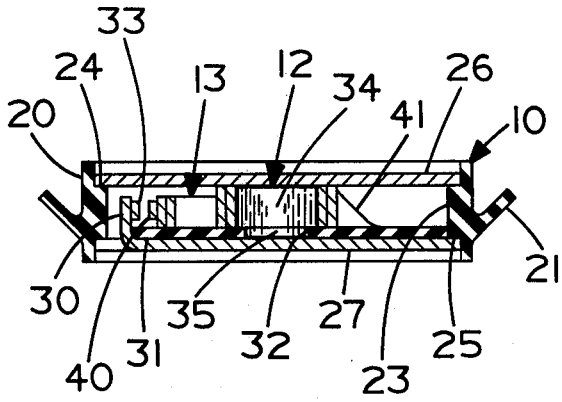
FIG. 4 is a cross-sectional view of the lamp-starting device as seen on line 4—4 of FIG. 3.
Figure 5:
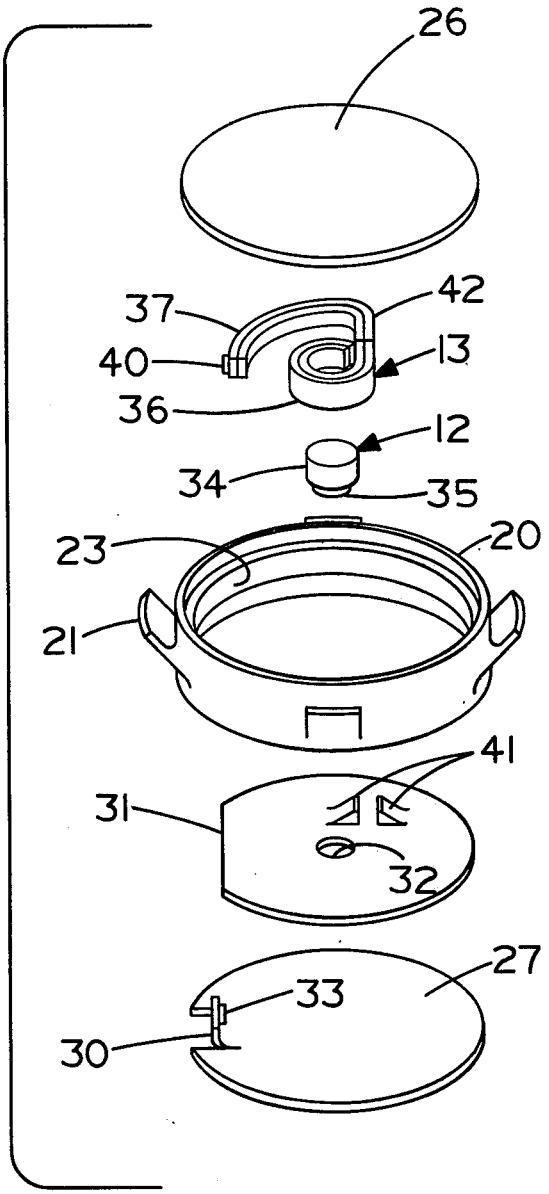
FIG. 5 is an exploded view of the component parts of the lamp-starting device.

In FIG. 2, the lamp-starting device 10 is disposed in the bottom of a lamp socket 14. The lamp socket 14 includes as a component part, a contact 15 that is electrically connected to the lamp-starting device 10 in a manner later described in detail. The lamp 11 includes a base 16 that is threadedly connected in and to the lamp socket 14. The lamp base 16 includes an electrical contact 17 that is electrically connected to the lamp-starting device 10 in a manner later described.

The lamp-starting device 10 includes a substantially cylindrical housing 20 made of electrically insulating material. The housing 20 includes a plurality of flexible tabs 21 spaced about its periphery, the tabs 21 resiliently engaging the inside wall 22 of lamp socket 14 to position and hold the lamp-starting device in place. The housing 20 also includes an internal, integral ring 23 providing an upper peripheral shoulder 24 and a lower peripheral shoulder 25.

A pair of electrically-conductive metal plates 26 and 27 are disposed in spaced relation in and electrically insulated from each other by the housing 20. The plate 26 is seated on and is fixed to the internal housing shoulder 24. The plate 27 is seated on and is fixed to the internal housing shoulder 25. The lower plate 27 includes an up-struck tab 30 that carries a first contact 33.

Disposed on top of and contiguous to the lower plate 27, is an electrically-insulating member 31. This electrically-insulating member 31 is provided with a central aperture 32.

Located between and electrically connecting the plates 26 and 27 is an electrical resistor 12. The resistor 12 includes a relatively enlarged cylindrical portion 34 and a relatively reduced cylindrical portion 35. The enlarged resistor portion 34 is located between and engages the plate 26 and the electrically-insulating member 31. The reduced resistor portion 35 extends through the aperture 32 of the electrically-insulating member 31 and engages the plate 27.

When the lamp-starting device 10 is installed in the lamp socket 14 as illustrated in FIG. 2, the socket contact 15 engages the plate 27. When the lamp 11 is fully attached to the lamp socket 14, the base contact 17 engages the plate 26. Consequently, when the circuit is initially energized, the resistor 12 is effectively in the circuit in series with the lamp filament.

The temperature-responsive bimetal strip 13 is located between the electrically-insulating member 31 and the plate 26, the bimetal strip 13 being electrically connected to the plate 26. This bimetal strip 13 includes a loop portion 36 disposed about the enlarged resistor portion 34, and disposed between and engaging the plate 26 and the electrically-insulating member 31. Further, the bimetal strip 13 includes a curvilinear end portion 37 of slightly reduced height that carries a second contact 40, the end portion 37 being movable to engage the contacts 33 and 40 when the bimetal strip 13 is heated by conductive heat from the resistor 12, lamp base 16 and socket 14.

The electrically-insulating member 31 includes a pair of spaced holders 41 that receive and retain a bimetal strip portion 42 that integrally connects the loop portion 36 and the movable end portion 37 of reduced height.

It will be understood that when the contacts 33 and 40 electrically engage upon movement of the bimetal strip end portion 37 when sufficiently heated by conductive heat from the resistor 12, lamp base 16 and socket 14, the resistor 12 is by-passed in the electrical circuit so that full rated voltage is applied to the lamp filament. The path of current flow is then through the bimetal strip 13 and the closed contacts 33 and 40.

It is thought that the usage and functional advantage of this lamp-starting device 10 has become fully apparent from the foregoing detailed description, but for completeness of disclosure, the installation of the lamp-starting device 10 and its operation will be briefly described.

First, the lamp-starting device 10 is inserted into the lamp socket 14 by threadedly inserting the housing tabs 21 and then pressing the housing 20 to the bottom of the socket 14 until the socket contact 15 engages the plate 27. The housing tabs 21 resiliently engage the internal wall 22 of the lamp socket 14 and retain the device 10 in place.

Then, the lamp 11 is installed in the lamp socket 14 by threadedly inserting the lamp base 16. The base contact 17 will engage the plate 26 of the lamp-starting device 10.

When the lamp circuit is initially energized, current to the lamp filament will flow from the socket contact 15 to the lamp base contact 17 through the resistor 12 and the plates 26 and 27. Because the resistor 12 is in series with the lamp filament, the lamp is turned on at less than rated voltage.

After a short time period, the conducted heat from the resistor 12, lamp base 16 and socket 14 to the lamp-starting device 10 will cause the bimetal strip 13 to close the switch contacts 33 and 40 so as to effectively and completely by-pass the resistor 12. The current flow from the socket contact 15 to the lamp base contact 17 will be through the bimetal strip 13, the closed contacts 33 and 40, and the plates 26 and 27. Consequently, full rated voltage is applied to the lamp 11 to operate at full rated capacity.

It will be importantly understood that the resistor 12 is either completely in or out of the lamp circuit. Upon initial energization of the circuit, the resistor 12 is completely in the circuit so that less than rated voltage, say only ¾ voltage, is applied to the lamp 11. When the bimetal strip 13 closes the switch contacts 33 and 40 when heated by conductive heat from the resistor 12, lamp base 16 and socket 14, the resistor 12 is completely out of the circuit so that rated voltage is applied to the lamp 11. Because the lamp 11 is turned on at a relatively low voltage and full rated voltage is applied only after the lamp filament is relatively warm, the lamp life is increased significantly.

I claim as my invention:

1. A lamp-starting device for use in a lamp socket adapted to receive the base of the lamp, comprising:

a. a housing, b. a pair of electrically-conductive plates disposed in spaced relation in the housing, and electrically insulated from each other, one of the plates having a first contact located between the plates, c. an electrical resistor located between, engaging and electrically connecting the plates, the resistor being in the circuit when the lamp is initially energized, and d. a temperature-responsive bimetal strip located between the plates, the bimetal strip being electrically insulated from the said one plate, and electrically connected to and engaging the other of said plates that is adapted to engage the lamp base, the strip having a second contact movable into engagement with the first contact when the bimetal strip is heated by conductive heat from the lamp socket to by-pass the resistor in the circuit after initial energization.

2. A lamp-starting device as defined in claim 1, in which:

e. the housing is of electrically insulating material, f. the pair of plates are electrically insulated from each other by the housing, g. an electrically-insulating member is disposed between the plates to electrically insulate the bimetal strip from the said one plate, and h. the bimetal strip is located between and engages the electrically-insulating member and the said other plate.

3. A lamp-starting device for use in a lamp socket adapted to receive the base of the lamp, comprising:

a. a housing of electrically insulating material, b. a pair of electrically-conductive plates disposed in spaced relation in the housing, and electrically insulated from each other by the housing, one of the plates having a first contact, c. an electrical resistor located between and electrically connecting the plates, the resistor being in the circuit when the lamp is initially energized, d. a temperature-responsive bimetal strip located between the plates and electrically connected to the other of said plates, the strip having a second contact movable into engagement with the first contact when the bimetal strip is heated by conductive heat from the lamp socket to bypass the resistor in the circuit after initial energization, e. an electrically-insulating member disposed between the plates, f. the bimetal strip being located between the electrically-insulating member and the said other plate, and g. the bimetal strip including a loop disposed about the resistor and engaging the said other plate and the electrically-insulating member.

4. A lamp starting device as defined in claim 3, in which:

h. the electrically-insulating member includes spaced holders receiving and retaining the bimetal strip there-between.

5. A lamp starting device for use in a lamp socket adapted to receive the base of the lamp, comprising:

a. a housing of electrically insulating material, b. a pair of electrically-conductive plates disposed in spaced relation in the housing, and electrically insulated from each other by the housing, one of the plates having a first contact, c. an electrical resistor located between and electrically connecting the plates, the resistor being in the circuit when the lamp is initially energized, d. a temperature-responsive bimetal strip located between the plates and electrically connected to the other of said plates, the strip having a second contact movable into engagement with the first contact when the bimetal strip is heated by conductive heat from the lamp socket to bypass the resistor in the circuit after initial energization, e. an electrically-insulating member disposed between the plates, f. the bimetal strip being located between the electrically-insulating member and the said other plate, and g. the electrically-insulating member being disposed contiguous to the said one plate, and being provided with an aperture, and h. the resistor including a relatively enlarged portion and a relatively reduced portion, the enlarged portion being located between and engaging the said other plate and the electrically-insulating member, and the reduced portion being located in the aperture and engaging the said one plate.

6. A lamp-starting device as defined in claim 5, in which:

i. the bimetal strip including:

1. a loop portion disposed about the enlarged resistor portion and engaging the said other plate and the electrically-insulating member, and 2. a movable end portion that carries the said second contact.

7. A lamp-starting device as defined in claim 6, in which:

j. The electrically-insulating member including spaced holders receiving and retaining a bimetal strip portion located between the loop portion and movable end portion.

* * * * *